US006062052A

United States Patent [19]

Diaz de Tuesta

[11] Patent Number: 6,062,052

[45] Date of Patent: May 16, 2000

[54] LATCH LOCKING MECHANISM

[76] Inventor: Galo Diaz de Tuesta, 12777 Norton Ave., Chino, Calif. 91710

[21] Appl. No.: 09/334,707

[22] Filed: Jun. 16, 1999

[51] Int. Cl.[7] ..... B65D 55/14

[52] U.S. Cl. ..... 70/162; 70/164; 70/202; 70/371; 292/85

[58] Field of Search ..... 70/159–164, 166–169, 70/202, 211, 371; 292/85, 88, 89

[56] References Cited

U.S. PATENT DOCUMENTS

| | | | |
|---|---|---|---|
| 319,651 | 6/1885 | Wilson | 292/89 X |
| 1,774,850 | 9/1930 | Snook | 292/89 |
| 2,523,505 | 9/1950 | Hautzeuroeder | 292/85 |
| 2,664,735 | 1/1954 | Vahlstrom et al. | 292/89 X |
| 3,745,796 | 7/1973 | Fleming | 70/81 |
| 4,370,873 | 2/1983 | Edmunds | 70/167 X |
| 4,565,080 | 1/1986 | Kincaid et al. | 70/215 |
| 4,912,950 | 4/1990 | Crowle | 292/89 X |
| 4,964,659 | 10/1990 | Baldwin | 70/168 X |
| 5,056,858 | 10/1991 | Tanaka | 292/85 X |
| 5,860,302 | 1/1999 | James | 70/168 X |

*Primary Examiner*—Lloyd A. Gall
*Attorney, Agent, or Firm*—Boniard I. Brown

[57] ABSTRACT

Lock apparatus for a latch assembly comprises a lock cylinder or cartridge inserted via an opening provided in a latch body and retained by a lock bolt thereof to engage a latch assembly spring to prevent disengagement thereof from a stationary catch; the lock cylinder is removable for unlocking by retraction of its bolt, typically by key operation.

19 Claims, 2 Drawing Sheets

LATCH LOCKING MECHANISM

BACKGROUND AND SUMMARY OF THE INVENTION

The present invention provides locking improvements for prior latch mechanisms for lids of compartments or enclosures hingedly mounted thereon.

A handle, typically a flap handle, is operable to open the latch to lift the lid, by operating an actuator on the handle to disengage a spring from a catch mounted on the enclosure, defining a shoulder to retain the spring. The latch is closable by moving the lid downwardly to snap the spring into engagement under the catch shoulder.

The prior latch apparatus is vulnerable to unauthorized entry by thieves and other persons, thus giving access to private items, and theft of contents from the enclosure, such as equipment and an engine.

The present invention resolves the problem of unauthorized entry and theft by providing a locking cylinder insertable via an opening in a latch assembly body, which engages and retains the spring against disengagement from the catch shoulder. Unlocking and removal of the lock cylinder enables raising of the lid.

DESCRIPTION OF THE PREFERRED EMBODIMENT

Figure 1:
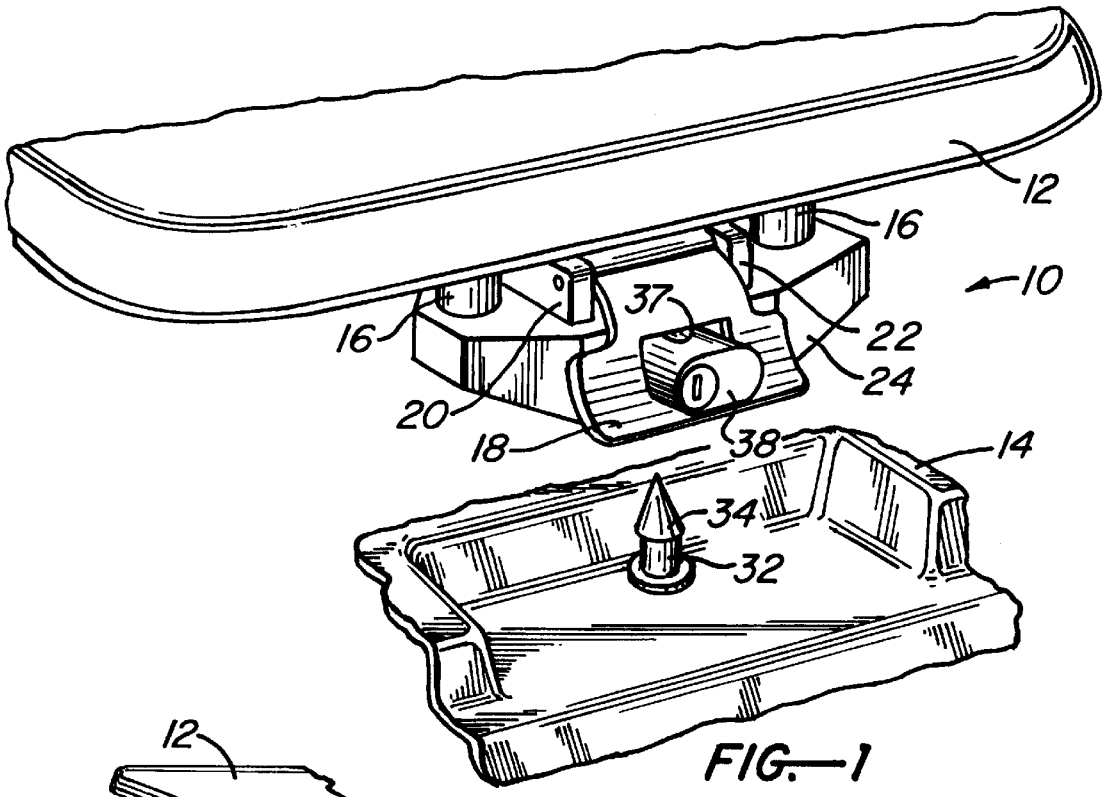
FIG. 1 is a partial perspective view showing a latch assembly on a lid and a catch on an enclosure, with which the lock apparatus of the invention is utilized.
Figure 2:
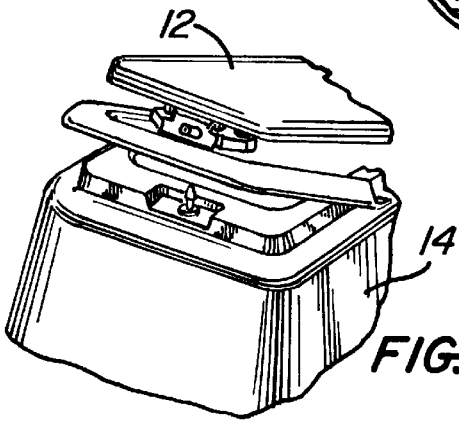
FIG. 2 is a partial perspective view of a latch assembly on an enclosure or compartment with a lid closed thereon.
Figure 4:
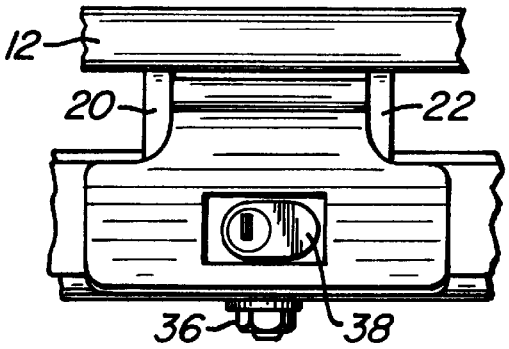
FIG. 4 is a partial front view of the latch assembly of FIG. 1 showing a lock cylinder of the invention therein.

The present invention provides improvements on prior art latch mechanisms, for locking and securing lids and covers of compartments and enclosures with which the prior latch mechanisms are utilized.

A latch assembly 10 is mounted on a lid 12 hingedly mounted on a compartment 14, which is typically disposed on a power boat or other vehicle. The latch assembly is secured on the underside of the lid by threaded fasteners (not shown) enclosed within spacers 16. A flap handle 18 is pivotally mounted on a shaft extending between mounting arms 20, 22, as shown, extending upwardly from a body member 24 of the latch assembly.

Figure 6:
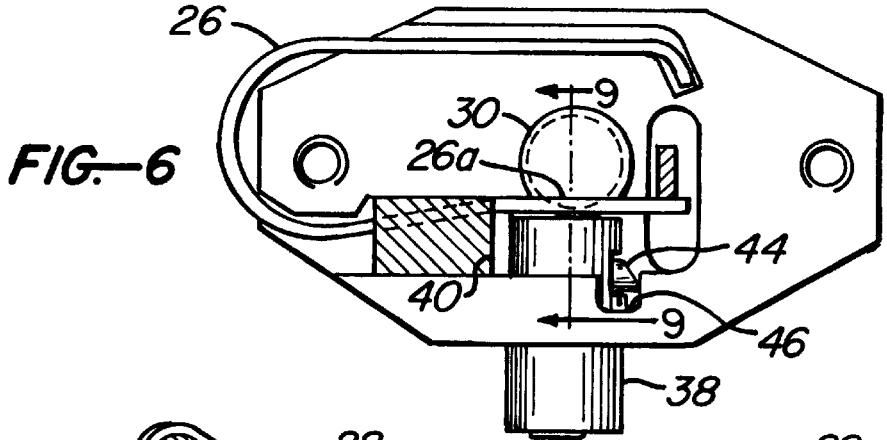
FIG. 6 is a bottom view of the latch assembly of FIGS. 1 and 5 showing a lock cylinder of the invention secured in operative position by a bolt extending therefrom.
Figure 7:
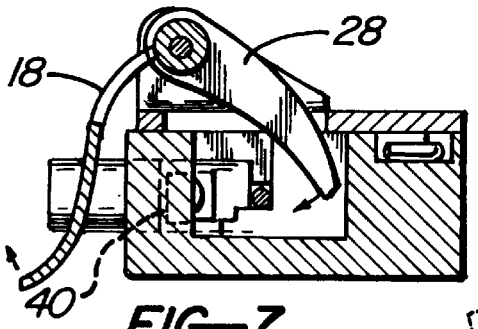
FIG. 7 is a sectional view taken at line 7—7 in FIG. 5.
Figure 8:
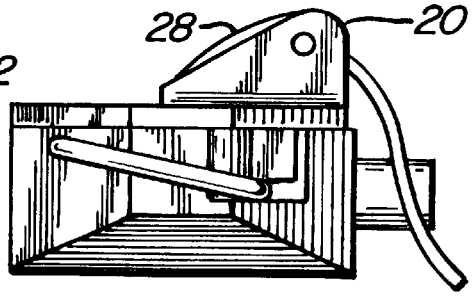
FIG. 8 is a side view taken at line 8—8 in FIG. 5.
Figure 9:
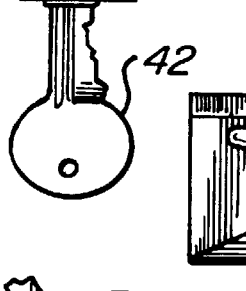
FIG. 9 is a fragmentary sectional view of a portion of FIG. 7 showing the spring in latched position and in release position.
Figure 9:
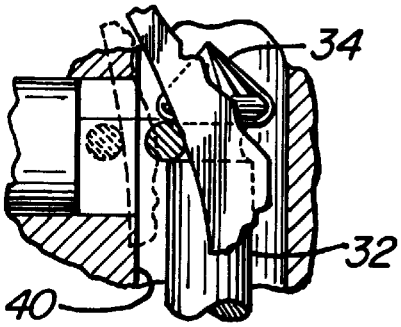

A generally U-shaped loop spring 26 is retained in a groove in a lower portion of the body member, as shown in FIG. 6, with a portion of spring 26 extending across transverse central opening 30.

A lever arm actuator 28 is rigidly attached to the flap handle 18 and is pivotable therewith so that manual raising of the flap handle pivots the lever arm to engage a portion 26*a* of spring 26 extending across a portion of a central opening 30 in the body member, thereby disengaging the spring portion 26*a* from under a shoulder 32 of a conical catch 34, which is secured on an upper portion of the compartment 14 by engagement of its threaded lower portion with a securing nut 36, as shown. The spring is thus disengaged from under the shoulder to enable raising of the lid of the compartment. The latch is closed by urging downwardly the lid 12 or the flap handle 18 to snap spring portion 26*a* into engagement under the shoulder 32 of the latch member.

The above-described conventional arrangement is vulnerable to entry and access by unauthorized persons, such as thieves, for removal of contents from the compartment or removal and theft of an engine and/or other equipment therein, simply by raising the flap handle and lifting the lid.

Figure 3:
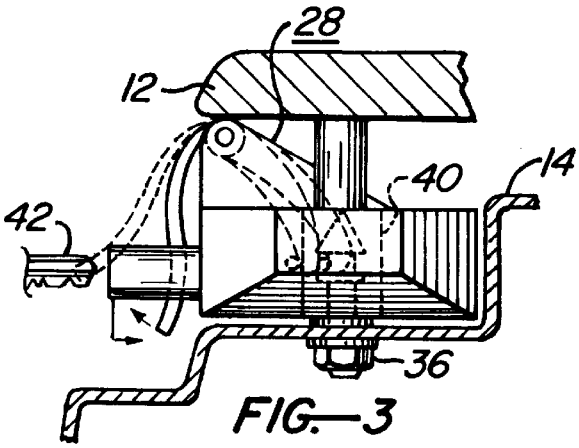
FIG. 3 is a partial sectional view of a latch locking assembly of FIG. 1 in relation to a lock cylinder according to the invention.
Figure 5:
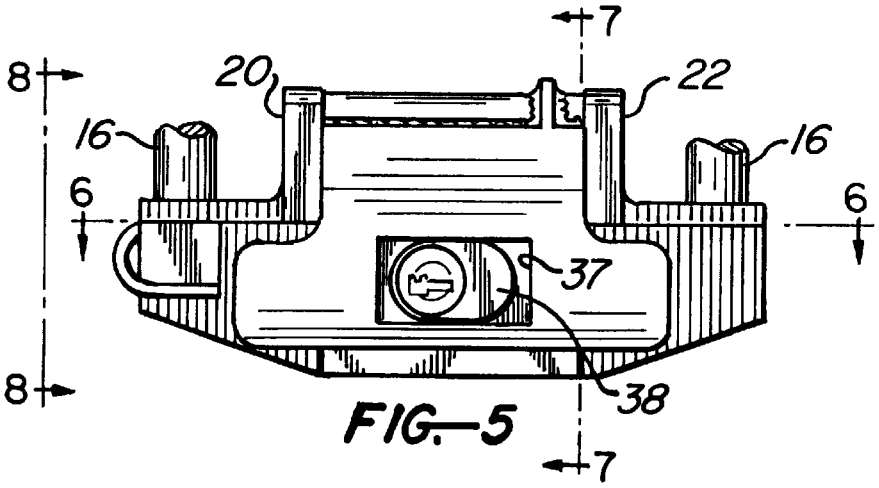
FIG. 5 is a front view of the latch assembly with its flap handle lowered and a lock cylinder of the invention therein.

The present invention provides a locking apparatus for securing and preventing access to the enclosure or compartment and its contents by unauthorized persons. According to the invention, an opening 37 is defined in the flap handle and is adapted to receive a lock mechanism cylinder 38, typically a pin tumbler lock mechanism, and an opening or passage 40 for the lock cylinder is defined in body member 24, as shown in FIGS. 3 and 6.

To effect locking, the lock cylinder 38 is inserted into the body member via the opening or passage 40 and a key 42 is rotated to extend a bolt 44 radially outwardly into engagement with a shoulder or wall portion 46 in the body member (FIG. 6), in which position the lock cylinder engages the spring portion to prevent movement thereof out of engagement with the shoulder to retain the spring in engagement with the catch shoulder, thus to prevent raising of the lid. The lock cylinder cannot then be removed from the body member, except by retracting the bolt by rotation of the key to enable manual withdrawal of the lock cylinder.

Thus there has been shown and described a latch locking mechanism which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. In a latch assembly disposed between a lid and an enclosure and latched by engagement of a spring member thereon with a catch extending on the enclosure to receive the spring member to releasably retain the lid and the spring being disengaged from the catch by a handle-operated actuator to urge the spring from engagement with the catch, a locking apparatus comprising:

said latch assembly having an opening therein, and a lock cylinder insertable via said opening into proximity with said spring and securable in a body member by extension off a bolt thereon to engage a retaining shoulder in the body member to prevent spring movement by the actuator and prevent disengagement of the spring from the catch, said lock cylinder being removable from the body member by retraction of the lock cylinder bolt to enable said actuator to disengage the spring from the catch.

2. A locking apparatus according to claim 1, wherein:

said bolt is extensible generally radially of the lock cylinder to engage a shoulder defined in the body member to retain the lock cylinder substantially in engagement with the spring to retain the lock cylinder, and said bolt is retractable to release the lock cylinder for removal via the opening to enable disengagement of the spring from said catch.

3. A locking apparatus according to claim 1, wherein:

said catch is mounted on an upper portion of the enclosure and has a shoulder adapted to retain said spring.

4. Apparatus according to claim 3, wherein said catch has a generally conical head portion defining a shoulder thereunder adapted to receive said spring.

5. Apparatus according to claim 3, wherein:

the catch is positionable in an opening in the body member for engagement with said spring under said shoulder of the catch.

6. Apparatus according to claim 1, wherein the spring has a portion engagable under a shoulder of the catch.

7. Apparatus according to claim 1, wherein the latch assembly is mounted on the lower side of the lid.

8. Apparatus according to claim 2, wherein said lock cylinder comprises a pin tumbler mechanism.

9. Apparatus according to claim 1, wherein:

said actuator comprises an actuator arm pivotable with a handle to move a spring to disengage the spring from a shoulder of the catch.

10. Apparatus according to claim 9, wherein:

the actuator arm is secured to and disposed at a substantial angle relative to the handle and is pivotal therewith to urge the spring from engagement with the catch shoulder.

11. Apparatus according to claim 5, wherein:

said spring is of generally loop configuration and is retained in a groove in the body member with a portion of the spring extending into an opening in the body member.

12. In a latch assembly disposed between a lid and an enclosure and latchable by engagement of a spring member thereon with a catch mounted on an upper portion of the enclosure and having a shoulder to receive the spring member to releasably retain the lid relative to the enclosure, the spring being disengagable from the catch by an actuator arm to urge the spring out of engagement with the catch, a locking apparatus comprising:

means defining an opening in a body member of the latch assembly, a lock cylinder insertable via said opening and into engagement with said spring, the lock cylinder being securable by a bolt extensible generally radially from the lock cylinder to engage a retaining shoulder in the body member to retain the lock cylinder in substantial engagement with the spring to prevent movement of the spring by operation of the actuator arm to retain the spring in engagement with a shoulder defined on the catch, and said lock cylinder by retraction of said bolt disengaging the lock cylinder from the retaining shoulder and the body member, whereby operation of the actuator arm disengages the spring from the shoulder of the catch.

13. Apparatus according to claim 12 wherein said catch is mounted by a threaded fastener to an upper wall portion of the enclosure and defines a shoulder adapted to retain the spring.

14. Apparatus according to claim 12, wherein the latch assembly is mounted on a lower side of the lid.

15. Apparatus according to claim 12, wherein said lock cylinder comprises a pin tumbler mechanism.

16. Apparatus according to claim 12, wherein:

said actuator arm comprises an actuator arm pivotable with a handle to disengage the spring from under said shoulder of the catch.

17. Apparatus according to claim 16, wherein:

the actuator arm is secured to and disposed at a substantial angle relative to the handle and is pivotal therewith to disengage the spring from the catch shoulder.

18. Apparatus according to claim 12, wherein:

said catch extends into a second opening transverse to said first mentioned opening in the body member and engages the spring with the spring disposed under a shoulder of the catch to maintain said lid closed.

19. Apparatus according to claim 12, wherein:

said spring is of generally loop configuration and is retained in a groove in the body member with a portion of the spring extending across a portion of said first-mentioned opening in the body member.

* * * * *